United States Patent [19]

Green, Jr.

[11] Patent Number: 4,580,583

[45] Date of Patent: Apr. 8, 1986

[54] SMOKE GENERATING DEVICE

[76] Inventor: William D. Green, Jr., 8906 Camden st., Alexandria, Va. 22308

[21] Appl. No.: 588,363

[22] Filed: Mar. 12, 1984

Related U.S. Application Data

[63] Continuation-in-part of Ser. No. 251,074, Apr. 6, 1981, Pat. No. 4,436,100, and a continuation-in-part of Ser. No. 104,701, Dec. 17, 1979, Pat. No. 4,259,970.

[51] Int. Cl.[4] ..... A24F 47/00

[52] U.S. Cl. ..... 131/330; 131/185

[58] Field of Search ..... 131/329, 330, 185; 99/467, 474, 481, 482; 110/102, 108, 118; 431/168, 173

[56] References Cited

U.S. PATENT DOCUMENTS

| | | | |
|---|---|---|---|
| 1,174,088 | 3/1916 | Mulock | 110/118 |
| 2,960,981 | 11/1960 | Robertson | 131/330 |
| 3,785,304 | 1/1974 | Stookey | 110/118 |
| 3,804,104 | 4/1974 | Fariello | 131/185 |
| 3,889,690 | 6/1975 | Guarnieri | 131/185 |
| 4,164,230 | 8/1979 | Pearlman | 131/330 |
| 4,259,970 | 4/1981 | Green, Jr. | 131/185 |
| 4,270,464 | 6/1981 | Keres | 99/482 |
| 4,436,100 | 3/1984 | Green, Jr. | 131/330 |

*Primary Examiner*—V. Millin
*Assistant Examiner*—H. Macey
*Attorney, Agent, or Firm*—Jacob Shuster

[57] ABSTRACT

A rotor assembly driven by a motor, supports a burner element within a combustion chamber from which smoke is withdrawn. Combustible material stored in a hopper chamber is gravitationally fed into the combustion chamber with an inflow of air induced by rotation of blower vanes on the rotor assembly to produce the smoke when the burner element is electrically energized.

25 Claims, 22 Drawing Figures

SMOKE GENERATING DEVICE

BACKGROUND OF THE INVENTION

This invention relates to improvements in smoke generating and dispensing devices of the type disclosed in my prior copending application, Ser. No. 251,074, filed Apr. 6, 1981, now U.S. Pat. No. 4,436,100 and an earlier application Ser. No. 104,701, filed Dec. 17, 1979 copending therewith, now U.S. Pat. No. 4,259,970, the present application being a continuation-in-part of the two earlier copending applications.

According to the disclosures in my prior copending applications, combustible material stored in a hopper is gravitationally fed to a combustion zone in order to generate smoke. An inflow of air is induced by a motor driven blower and the flow stream produced conveys the combustible material from the blower to the combustion zone located on the upstream side of a gas permeable screen element blocking outflow of the material from the combustion zone. Accordingly, only the smoke generated in the combustion zone passes through the screen for discharge. The gas permeable screen and a burner element are fixedly mounted on the downstream side of the combustion zone in order to effect combustion of the material on the upstream side of the screen.

One of the problems arising with the foregoing devices resides in a degradation of conditions favorable to combustion within the combustion zone with continued use of the device. Such degradation of favorable combustion conditions occurs because of accumulations of combustion residues to reduce combustion zone volume, increase flow losses, and decrease the supply of combustion supporting air and infeed of combustible material. It is therefore an important object of the present invention to provide an improved smoke generating device which will maintain and enhance favorable combustion conditions within the combustion zone in an economical and efficient manner.

SUMMARY OF THE INVENTION

In accordance with the present invention, the combustion zone in the foregoing type of smoke generating and dispensing device is enclosed by a rotating support for blower vanes, the burner element and a screen element. The screen element according to certain embodiments operates as a porous flow restrictor located on the downstream side of the combustion zone as in the case of the arrangements disclosed in my prior copending applications. The burner element, however, lines the wall of the combustion zone, which is located upstream of the blower vanes. Further, the wall surface of the combustion zone encloses the burner element. A more uniform combustible mixture is thereby achieved and accumulation of residues within the combustion chamber does not interfere with discharge of smoke and air or with the continued collection of material in the combustion chamber.

According to some embodiments of the invention, an electrical energizing circuit for the burner element is established through brushes displaced into wiping contact with the conductor surfaces by a control pushbutton. In other embodiments, axially displaceable sections of the housing control actuation of a switch through which the blower motor and burner element are energized. In all embodiments, the smoke generated in the combustion chamber is discharged directly from the blower chamber through a discharge opening in the housing.

BRIEF DESCRIPTION OF THE DRAWINGS

Various embodiments of the invention are described in greater detail hereinafter, with reference to the accompanying drawings, wherein.

DETAILED DESCRIPTION OF PREFERRED EMBODIMENTS

Figure 1:
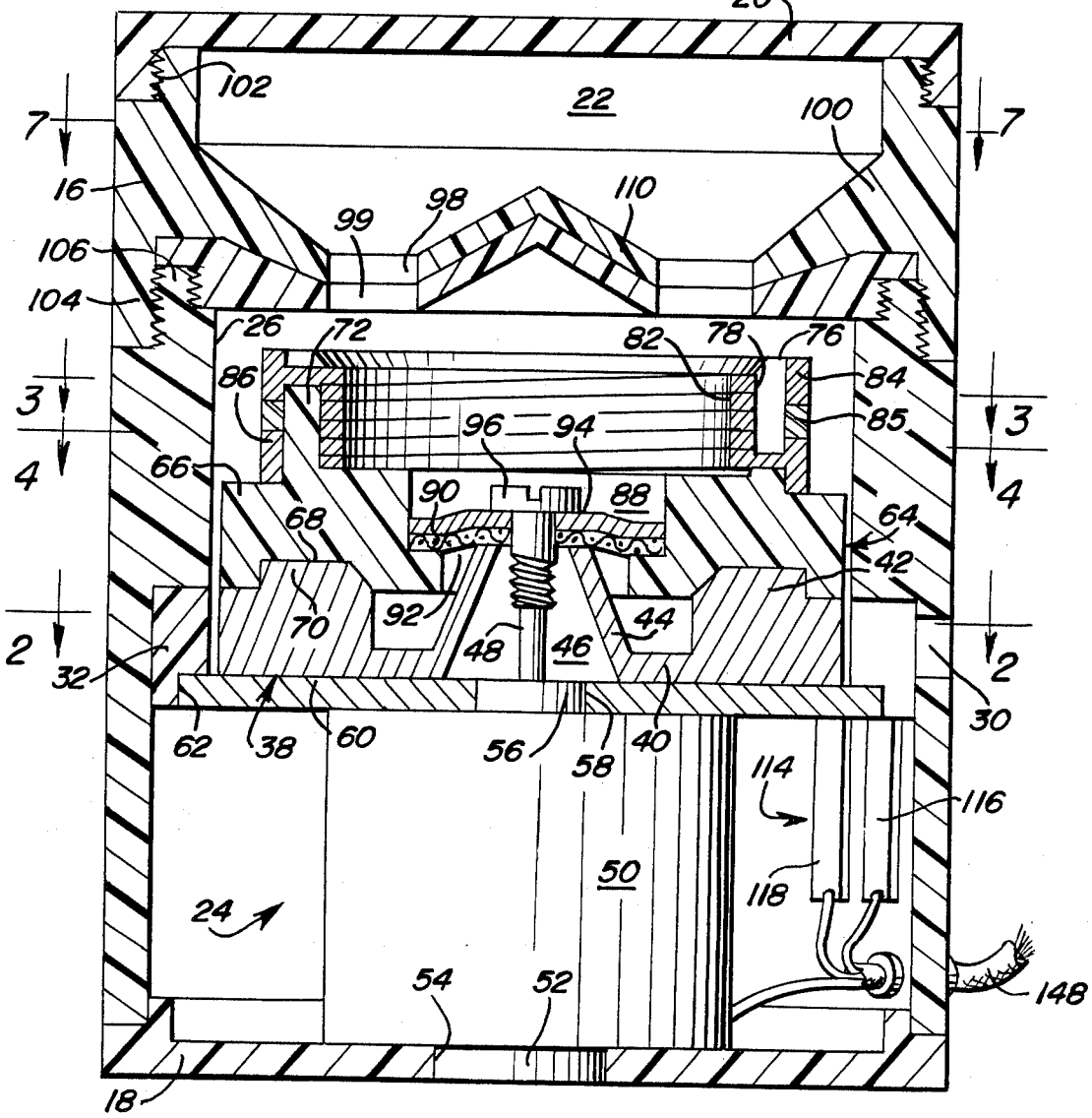
FIG. 1 is a side section view through a smoke generating and dispensing device in accordance with one embodiment of the invention.

Referring now to the drawings in detail, FIG. 1 illustrates one embodiment of the invention generally referred to by reference numeral 10 in the form of a smoke generating and dispensing device. The device 10 has a generally cylindrical housing 12 assembled from a lower cylindrical wall section 14 and an upper cylindrical wall section 16. A bottom end wall 18 is secured to a lower axial end of section 14 while a cover 20 is threadedly secured to the opposite axial end of section 16. Cover 20 is removable so as to provide access to a hopper chamber 22 enclosed by housing section 16 in axial alignment with a blower assembly 24 enclosed by the lower housing section 14.

Figure 2:
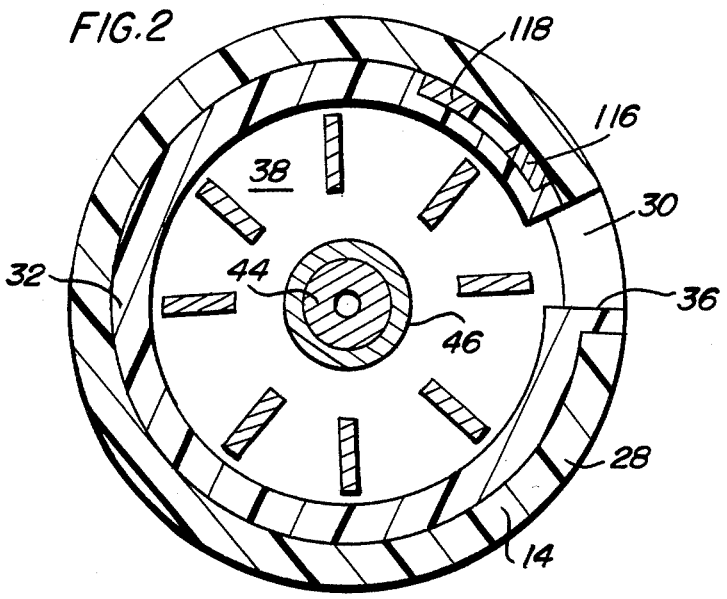
FIG. 2 is a transverse section view taken substantially through a plane indicated by section line 2—2 in FIG. 1.

The lower housing section 14 includes an upper internal surface portion 26 of smaller diameter than a lower internal surface portion 28 having a smoke discharge opening 30 formed therein as shown in FIGS. 1 and 2. A heat insulating liner 32 abuts shoulder 34 between the upper and lower portions 26 and 28 of the housing section 12 and is in frictional engagement with the surface portion 28. The liner has a gap aligned with smoke discharge opening 30. A radial flange 36 extending through the opening, as seen in FIG. 2, enables one to manually rotate the liner and thereby adjust the size of the opening 30.

The bladed rotor 38 includes a disc portion 40 from which blades or vanes 42 extend in radially spaced relation to a conical hub portion 44. A conical insert 46 is fitted within the hub portion 44 and is formed with a central keying bore receiving the drive shaft of an electric drive motor 50 associated with the blower assembly. The motor 50 is positioned within housing section 14 by an axial end formation 52 received in an opening 54 of the end wall 18. A bearing portion 56 of the motor projects through a central opening 58 in a circular disc 60 seated within a recess 62 in the liner 32. The disc 60 forms a smoke barrier between the motor and rotor chambers as well as to maintain concentricity between the rotating and stationary parts of the blower assembly 24.

The support rotor 64 is enclosed by the upper surface portion 26 of the housing section 14 and includes a base portion 66 formed with an annular groove 68 to receive an annular projection 70 of the blower vanes 42. The support rotor is thereby coupled to the blower rotor 38 for rotation therewith. A diametrically smaller body portion 72 of the rotor 64 projects axially from the base portion 66 to enclose a generally conical combustion chamber 74 between one axial end 76 of the rotor 64 and the base portion 66. The body portion 72 of the rotor is formed with an internal surface 78. A coil shaped, electrical burner element 82 is seated in the rotor. One upper end of the burner element 82 is connected to an upper current collecting ring 84 while the other lower end is connected to a lower collecting ring 86. The rings 84 and 86 are press fitted onto the body portion 72 of the rotor and are separated by an electrically non-conductive ring 85. By means of the collecting rings 84 and 86, electrical current is conducted through the burner element 82.

The base portion 66 of the rotor is formed with a recess 88 at the small diameter end of the conical combustion chamber 74 to seat a gas permeable, screen element 90. The screen element is clamped to abutting ends of the hub 44 and insert 46 projecting into the recess 88 of the rotor 64 through a central opening 92 in the base portion 66. A spidered clamp element 94 in a stressed condition is held assembled over the screen element by a fastener 96 threadedly secured to the insert 46. An axial clamping pressure thereby holds the base portion 66 of the rotor 64 and the rotor 38 assembled against relative rotation and axial separation. The screen element 90 remains exposed to the conical combustion chamber between the spider arms of the clamp element 94 as more clearly seen in FIG. 3.

Particulate material stored in the hopper chamber 22 is fed into the combustion chamber through feed openings 98 formed in a partition wall 100 formed integral with the upper housing wall section 16 intermediate its threaded end portions 102 and 104 to which the cover 20 and the lower housing section 14 are respectively connected. The upper end portion 106 of the lower housing section is accordingly provided with external and internal threads for respective connection to the upper housing section 16 and a fixed wall element 108 clamped between the end portion 106 and partition wall 100 of the housing sections. The partition wall 100 and wall element 108 conforming thereto are provided with central conical portions 110 and 111 projecting axially into the hopper chamber so as to divert material stored therein toward the feed openings 98. These openings 98 are aligned with corresponding openings 99 in the wall element 108 when the housing section 16 is rotated to the position shown from a position in which openings 98 and 99 are misaligned. The openings 99 are aligned with the conical surface of the combustion chamber on which the heating element is seated.

Figure 5:
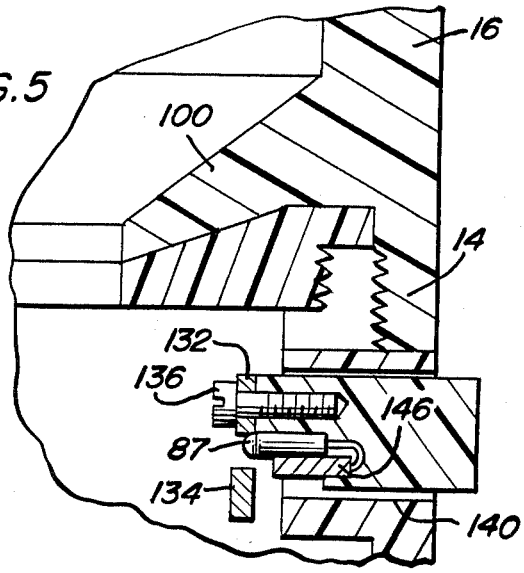
FIG. 5 is a partial section view taken substantially through a plane indicated by section line 5—5 in FIG. 3.
Figure 3:
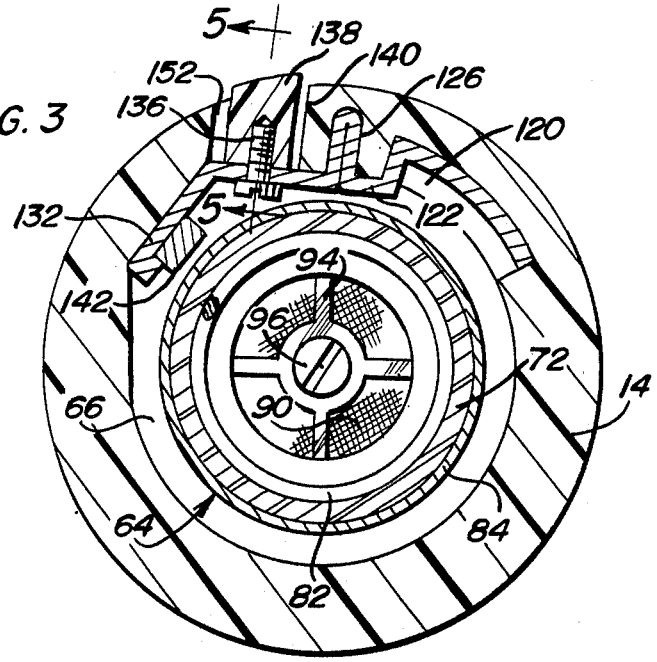
FIG. 3 is a transverse section view taken substantially through a plane indicated by section line 3—3 in FIG. 1.
Figure 3A:
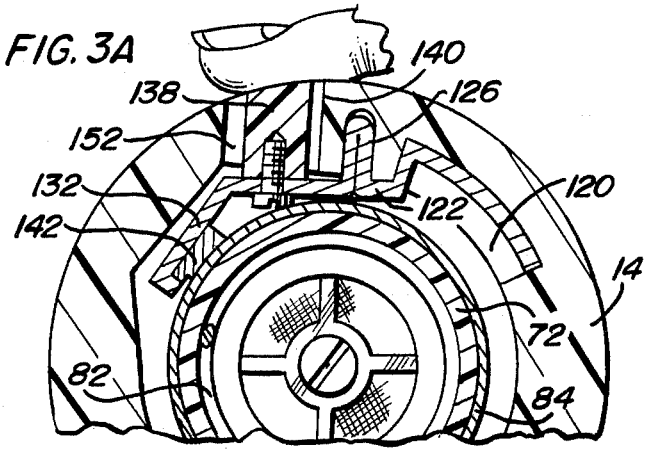
FIG. 3A is a partial section view similar to FIG. 3, but showing the device in an actuated position.
Figure 4:
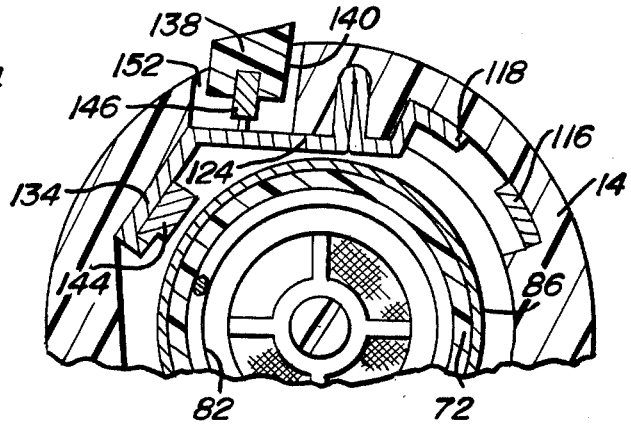
FIG. 4 is a partial transverse section view taken substantially through a plane indicated by section line 4—4 in FIG. 1.
Figure 6:
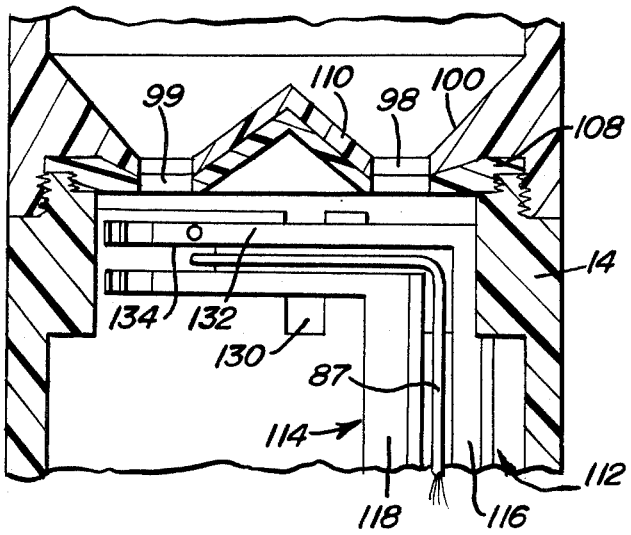
FIG. 6 is a partial section view taken substantially through a plane indicated by section line 6—6 in FIG. 5.
Figure 7:
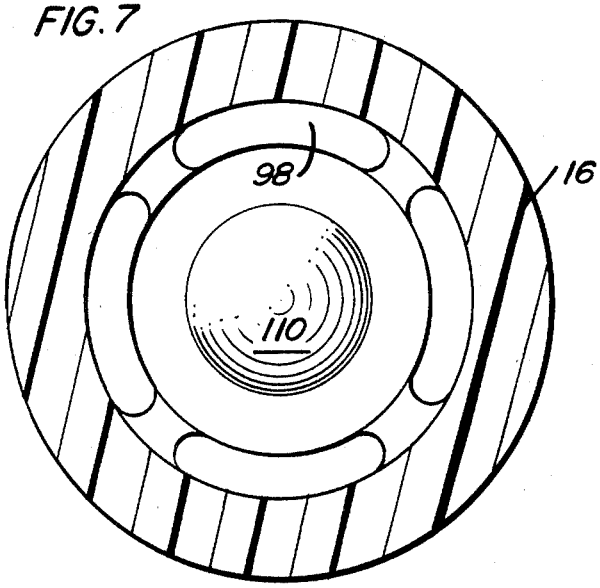
FIG. 7 is a partial transverse section view taken substantially through a plane indicated by section line 7—7 in FIG. 1.

Referring now to FIGS. 3, 4, and 6 in particular, a pair of electrical conductor elements 112 and 114 made of an elastically deformable material are provided and assembled within the lower housing section 14 to establish an electrical energizing circuit for the burner element 82 through the current collecting rings 84 and 86. The conductor elements include parallel spaced, vertical leg portions 116 and 118 seated within a vertical recess 120 formed in the upper surface portion 25 of the lower housing section. Horizontal arms 122 and 124 extend from the upper ends of the vertical leg portions 116 and 118 and are respectively anchored to the upper surface portion of housing section 14 by folded formations 126 and 128 received in an anchor slot 130, leaving free flexible end portions 132 and 134. The upper end portion 132 of arm 122 is connected by fastener 136 to a push button control element 138 projecting through an opening 140 in the upper portion of the housing section 14 as more clearly seen in FIG. 5. A brush element 142 is connected to the end portion 132 as shown in FIG. 3, while a brush element 144 is connected to end portion 134 as shown in FIG. 4. A pin 146 projects from push button control 138 into close adjacency to end portion 134 as shown in FIGS. 4 and 5. The arms 122 and 124 in their undeformed state as shown in FIGS. 3 and 4 abut the internal surfaces of the housing wall section 14 with brush elements 142 and 144 spaced from rings 84 and 86. An insulated conductor 87 extends from the motor 50 between arms 122 and 124 as shown in FIG. 6 to the pin 146. By depressing the push button 138, the pin 146 contacts end portion 134 to energize the motor 50 before the brush elements 142 and 144 contact collection rings 86 and 84 to energize burner element 82. Further depression of the push button brings both brush elements 142 and 144 into contact with rings 84 and 86 as shown in FIG. 3A. An energizing circuit is thereby completed through the conductor elements 112 and 114 for the burner element 82. The energizing circuits are opened upon release of the push button.

Figure 8:
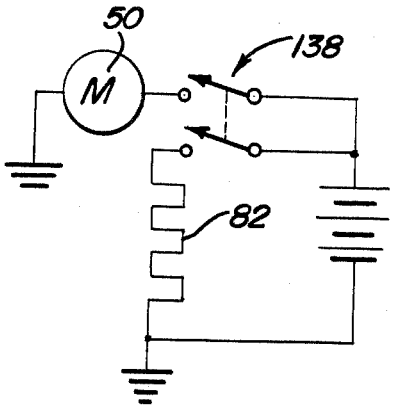
FIG. 8 is an electrical circuit diagram corresponding to the control system associated with the device shown in FIGS. 1–7.

The lower ends of the vertical legs 116 and 118 of the conductor elements 112 and 114 are electrically connected to a power source through power cord 148 as shown in FIG. 1. Power is also supplied through power cord 148 to the drive motor 50 as diagrammed in FIG. 8. It will also be apparent from FIG. 8, that the burner element 82 is energized by actuation of push button control 138 only after power is supplied to motor 50. Accordingly, the material burning operation is initiated only after the blower assembly is activated by operation of the drive motor 50.

Operation of the blower assembly induces an inflow of air to the combustion chamber 74 through passage 152 formed in the opening 140 alongside the push button control 138 as shown in FIGS. 3, 3A and 4. The rotation of the surface 74 on the support rotor 64 imparts vortical motion to the air mass enclosed therein so that centrifugal force urges the solid particles radially outwardly onto surface 74 for contact with the burner element 82. Accordingly, ideal combustion conditions are created in advance of and during energization of the burner element to generate smoke upstream of the screen element 90. The smoke is drawn through opening 92 in the base portion 66 of the rotating burner support body into the blower chamber enclosing bladed rotor 48 to discharge such smoke through opening 30.

FIGS. 9–13 illustrate another embodiment of the smoke generating and dispensing device having parts corresponding in arrangement and function to many of the parts hereinbefore described with respect to FIGS. 1–8. Thus, an electrically non-conductive housing 12' includes threadedly interconnected cylindrical wall sections 14' and 16'. The housing section 16' includes a cover portion 20' at the upper end thereof. A hopper chamber 22' is enclosed by housing section 16' below the cover portion 20' by a fixed conical wall formation 108' depending from the cover portion. The wall formation 108' also projects into a combustion chamber 74' enclosed by a support rotor 64' rotatably mounted within the housing section 14'. The rotor 64' includes a conical hub portion 44' within which an insert 46' is disposed, with a press fit on the drive shaft of motor 50'. The motor housing is fixed by fasteners 162 to a partition wall 164 integral with the housing section 14'.

The conical wall formation 108' depending from cover 20' has a central opening 154 through which particulate material stored in chamber 22' passes into the combustion chamber 74'. An annular grinder edge 156 projects from the wall formation, in surrounding relation to the opening 154, closely spaced from a disc element 152 bolted to the hub portion 44' of the rotor by a screw fastener 96' threaded into the insert 46'. Thus, particulate solids are comminuted in response to rotation of rotor 64' by the drive motor 50' for passage of only reduced size particles between the disc element 152 and annular grinding edge 156 into the combustion chamber 74'. Combustion supporting air is also fed to chamber 74' through opening 158 in the cover 20' and opening 154 at the bottom of storage chamber 22'.

The combustion chamber 74' is formed between the wall formation 108' and the cylindrical surface 78' of the rotor 64' to enclose the electrical burner element 82. The burner element is electrically connected to sections 170 and 171 of a split conductor ring connected to the bottom of the rotor 64'. The upper axial end of the rotor mounts blower vanes 42' disposed within an annular blower chamber enclosed by housing cover section 16' about the wall formation 108'. A smoke discharge opening 30' is formed in the housing section 16'.

It will be apparent that rotation of the rotor 64' causes blower operation inducing a vortical upflow through the combustion chamber 74'. With the burner element 82 electrically energized, combustion of comminuted particles occurs to produce smoke discharged by the blower vanes 42' through the discharge opening 30'. If the burner element is deenergized during rotation of the rotor, chamber 74' will be purged by the induced vortical upflow of air drawn in through chamber 22'.

Figure 9:
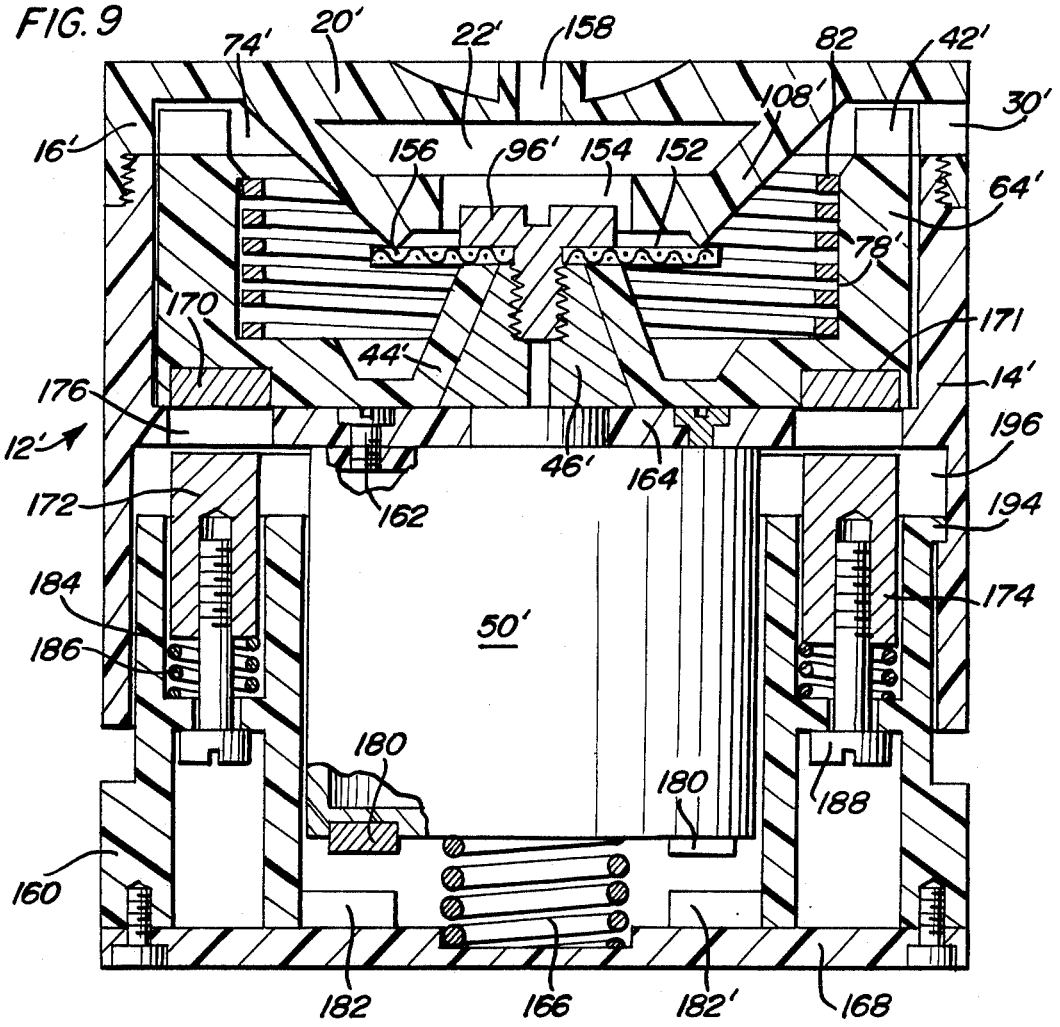
FIG. 9 is a side section view through a smoke generating and dispensing device, in accordance with another embodiment of the invention, in an inactive position.
Figure 11:
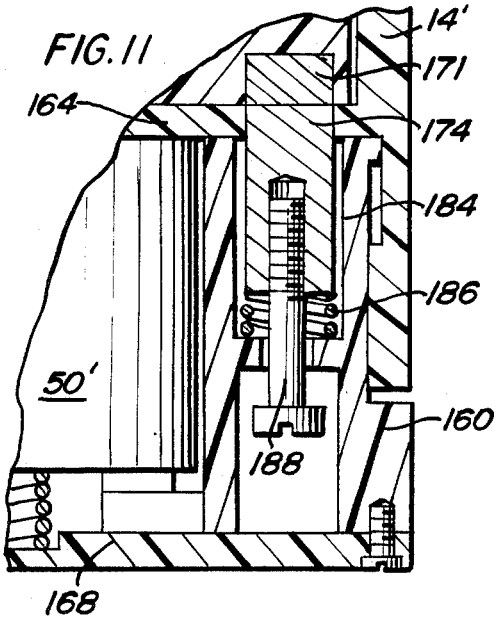
FIG. 11 is a partial side section view corresponding to FIG. 9, but showing the device in an activated burn position.

Energization of the drive motor 50' is effected by axial displacement of housing section 14' relative to a bottom housing section 160 enclosing the drive motor. The housing sections 14' and 160 are biased to an extended position as shown in FIG. 9 by a coil spring 166, the axial ends of which engage a botton wall 168 secured to the housing section 160 and the bottom of the motor housing suspended from the partition wall 164 of the housing section 14'. Contacts 180, 182 and 186 respectively fixed to the motor housing and the housing section 160 form a switch that is closed in the retracted position of the housing as shown in FIG. 11 to complete a motor energizing circuit as diagrammed in FIG. 13.

Figure 12:
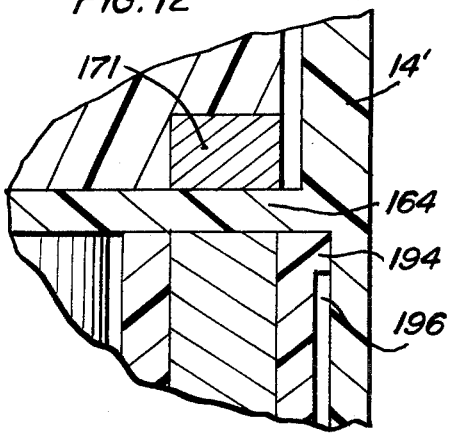
FIG. 12 is a partial side section view of the device of FIG. 9 in an activated, no burn position.
Figure 10:
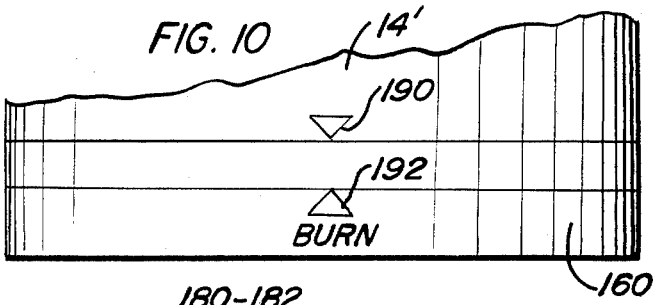
FIG. 10 is a partial elevation view of a bottom portion of the device shown in FIG. 9.
Figure 13:
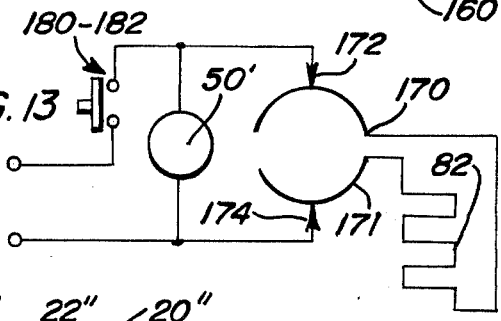
FIG. 13 is a simplified circuit diagram corresponding to the device of FIGS. 9–12.

The burner element 82 may be energized through conductor ring sections 170 and 171 and brush elements 172 and 174 simultaneously with the energization of motor 50' as diagrammed in FIG. 13. As shown in FIG. 9, the brush elements 172 and 174 are slidably mounted within parallel spaced, vertical bores 184 formed in the housing section 160 for alignment with the conductor ring sections 170 and 171. Coil springs 186 and 186' in the bores 184 and 184' bias the brush elements to extended positions shown in FIG. 9. Threaded adjustment screws 188 limit movement of the brush elements to such extended positions. The brush elements may be engaged with adjacent ring sections 170 and 171 by projection through aligned openings 176 and 176' formed in the partition wall 164 in response to manual displacement of the housing sections 14' and 160 against the bias of spring 166 to the retracted position shown in FIG. 11. Contact of the brush elements with the ring sections, however, requires angular alignment of the brush elements with the openings 176 in the wall 164 as indicated by the indicator indicia 190 and 192 in the external visible surfaces of housing sections 14' and 160 as shown in FIG. 10. Thus, relative angular displacement of the housing sections from the aligned burn position shown in FIGS. 9 and 10, will prevent contact between the brush elements and the ring sections 170 and 171 so that only the motor 50' will be energized when the housing sections are displaced to the axially retracted position as shown in FIG. 12. To prevent disassembly of the housing sections from the axially extended position, an arcuate projection 194 of the housing section 160 is slidably received within an axially elongated, arcuate recess 196 formed in the housing section 14' as shown in FIGS. 9 and 12.

It will be apparent that the user of the device shown in FIGS. 9–13 must angularly position the housing sections 14' and 160 to the burn position denoted by indicators 190 and 192 and then manually displace the housing sections to the axially retracted position against a spring bias in order to obtain simultaneous blower and burning operations for smoke generating and discharge purposes. Both operations are interrupted by release of the housing sections causing them to return to the extended position. Blower operation without burn may also be effected by axial displacement of the housing sections to an angularly "no burn" position.

Figure 9A:
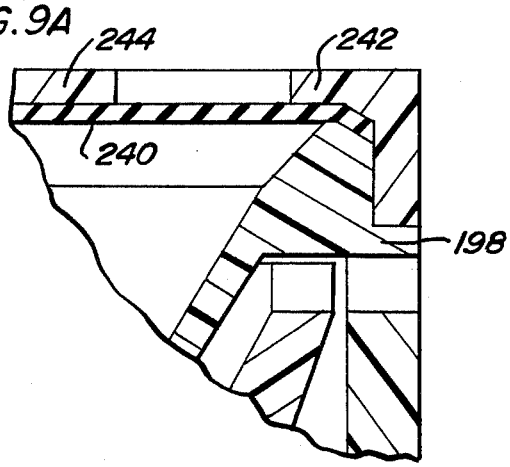
FIG. 9A is a partial section view showing a modification of the embodiment illustrated in FIG. 9.

FIG. 9A illustrates a modification of the housing hopper cover arrangement shown in FIG. 9. A flexible diaphragm cover 240 is peripherally clamped to an upper housing section 198 by an assembly ring 242 and has a rigid disc 244 centrally secured thereto. Thus material stored in the hopper chamber below cover 240 may be manually compressed by downwardly pressing disc 244 to enhance the grinding action.

Figure 15:
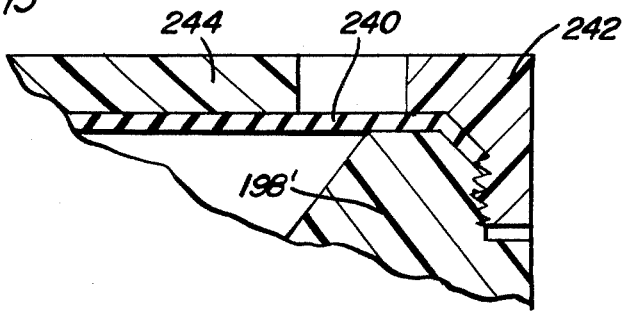
FIG. 15 is a partial side section view of still another embodiment.
Figure 16:
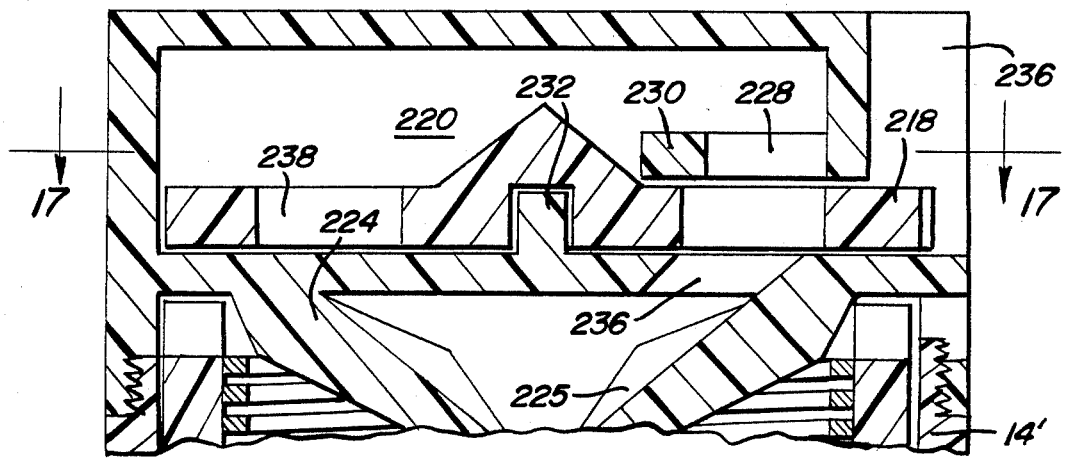
FIG. 16 is a partial side section view of a further embodiment.

Yet another modification is shown in FIGS. 15 and 16, which is also generally similar in arrangement and operation to the embodiment of FIGS. 9–13. The cover section of the housing is replaced by a cover section 216 to movably mount a material metering disc member 218 separating a material storing chamber 220. The housing section 216 is generally cylindrical as in the case of housing, section 16', but is axially extended and includes an integral partition wall 222 from which a conical wall 224 depends having vanes 225 to direct material feed from the storage chamber 220 toward screen element 152. An opening 226 is formed in the wall 222 through which particulate material descends from chamber 220. The opening 226 is in alignment with a formation 228 projecting inwardly from the cylindrical housing section 216 spaced above the wall 222 within chamber 220. A pivot shaft section 232 projects upwardly from wall 222 in alignment with the longitudinal axis of the housing to mount rotatable member 218. The member 218 has a knurled peripheral edge 234 exposed in an arcuate recess 236 formed in the housing section 216 to enable one to rotate the member 218. Angularly spaced metering openings 238 are formed in the member 218 adapted to be manually aligned with opening 226 for the infeed of material from chamber 220.

Figure 14:
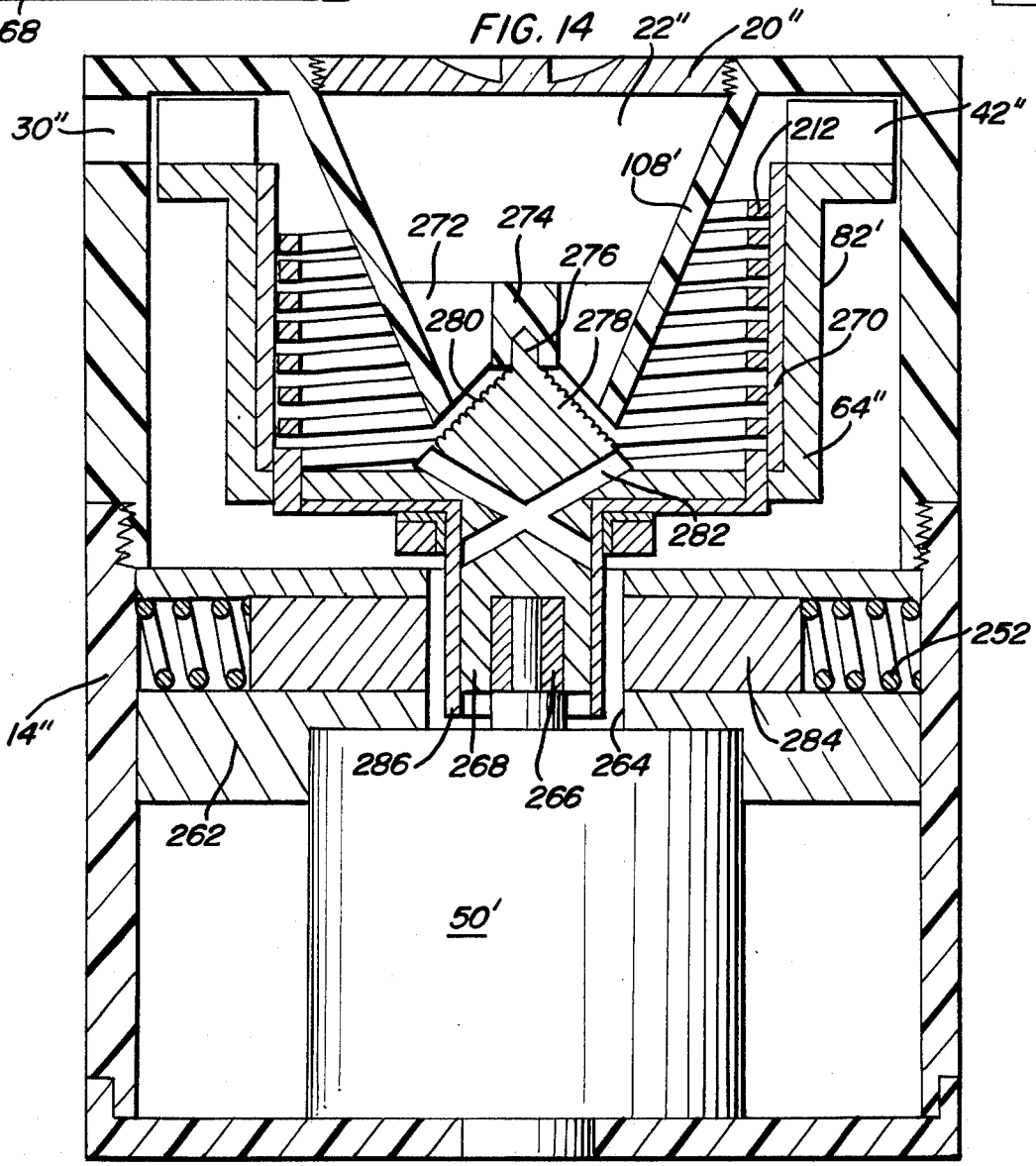
FIG. 14 is a partial side section view of yet another embodiment.
Figure 17:
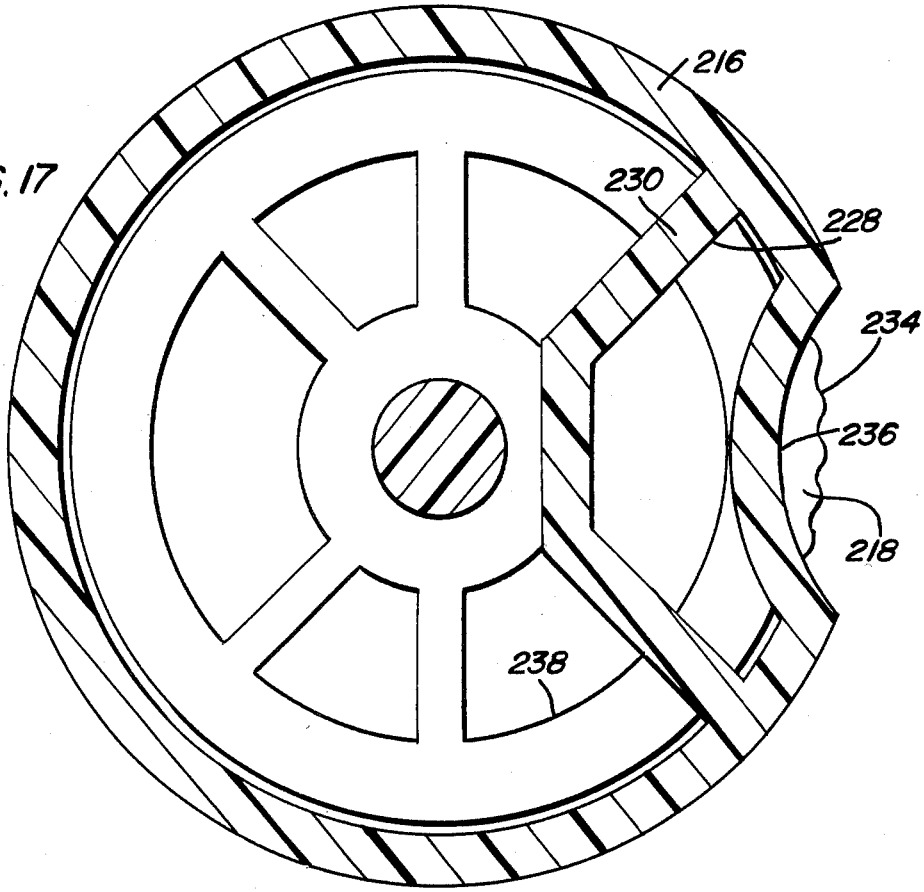
FIG. 17 is a transverse section view taken substantially through a plane indicated by section line 17—17 in FIG. 16.
Figure 18:
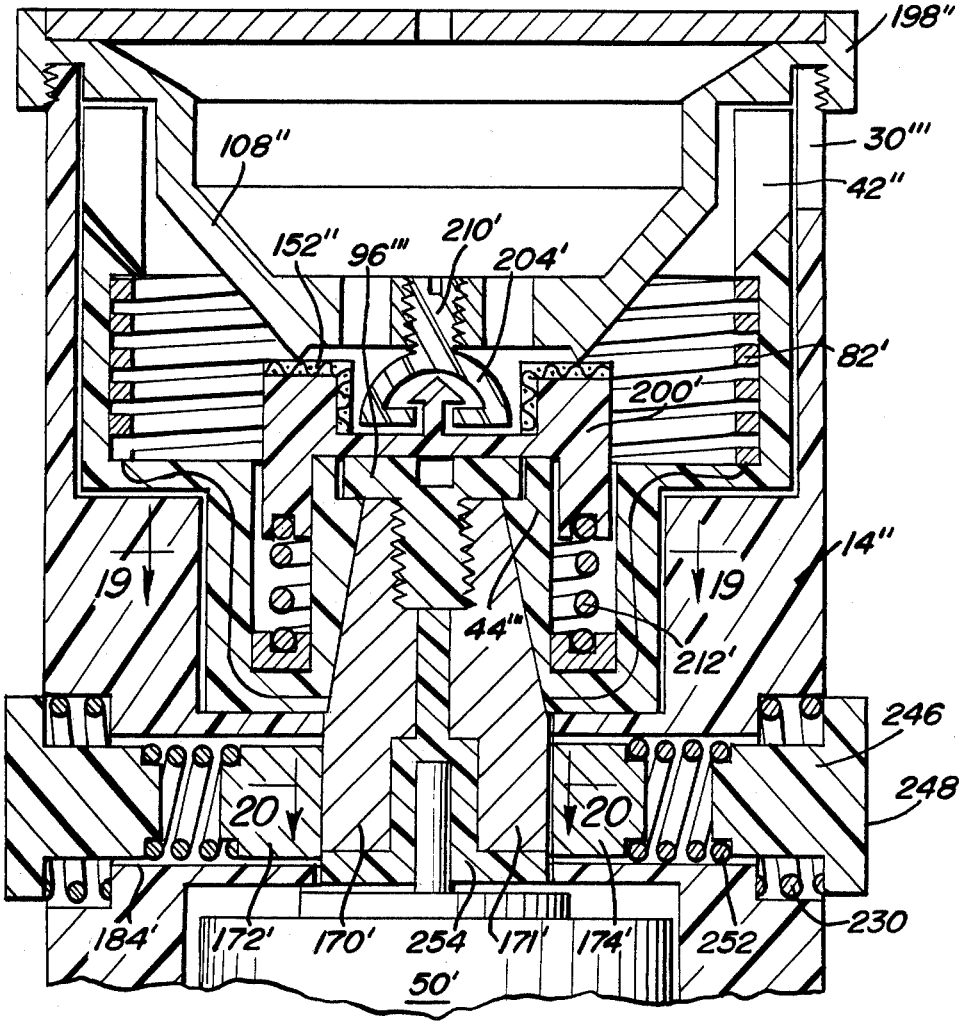
FIG. 18 is a partial side section view of an additional embodiment.
Figure 19:
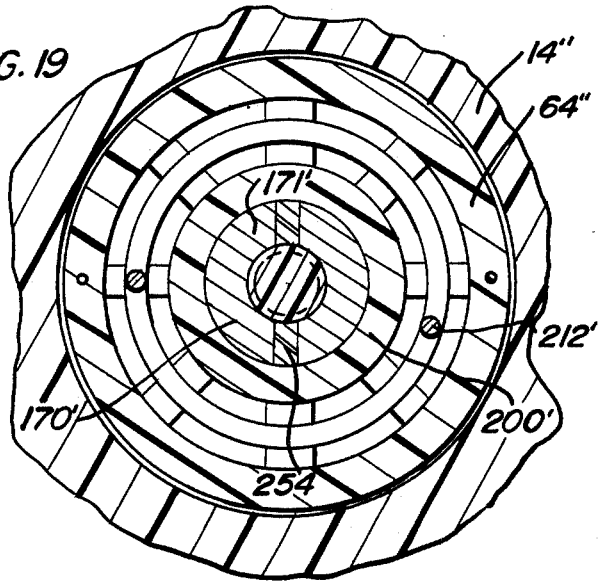
FIGS. 19 and 20 are partial section views taken substantially through planes indicated by section lines 19—19 and 20—20 in FIG. 18.

Another embodiment of the invention is shown in FIGS. 17, 18 and 19 embodying certain features of FIG. 14 and a modification of the brush arrangement of FIGS. 9–12. Thus, the screen element 152' shown in FIG. 18 is supported on the upper axial end of a support sleeve 200'0 for alignment with the circular grinding edge on wall formation 108''' under the axial pressure of a spring 212'. The rotor 64''' is provided with blower vanes 42'' for discharging smoke through opening 30''' in the housing section 14''. Removal of the screen 152''and its support sleeve is facilitated by means of the element 210' engaging a bearing pin 204' projecting from the support sleeve 200'. Element 210' is threadedly mounted in the wall formation 108'' for removal with the housing section 198''.

Figure 20:
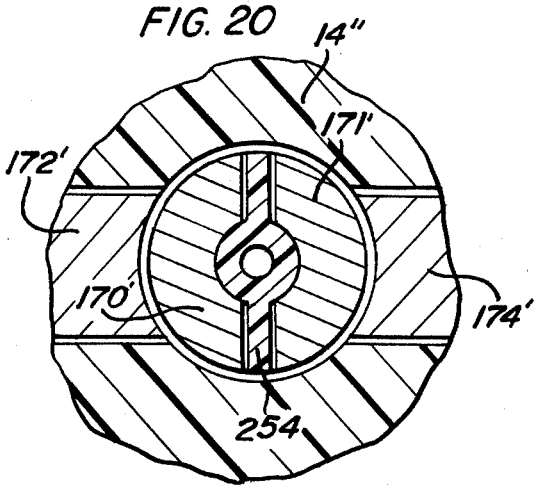

As seen in FIG. 18–20 the rotor 62''' supports another form of heater element 82' electrically connected to insert sections 170' and 171' held assembled in the hub portion 44''' of the rotor by screw fastener 96'''. The insert section acts as conductor ring sections rotatable with the rotor for contact by brush elements 172' and 174'. The brush elements are slidably mounted by the housing section 14'' within radial bores 184' which also receive slidable control plugs 246 having flange head portions 248 disposed externally of the housing section 14''. The control plugs are biased outwardly to extended positions as shown in FIG. 17 by coil springs 250. The control plugs are radially spaced from the brush elements by coil springs 252. In the non-stressed state of the coil springs 252 as shown, the brush elements are retracted within the bores 184' out of wiping contact with the conductor sections 170' and 171'. In such condition, no energizing circuit may be completed for the burner element 82'. To condition the burner element for energization, the control plugs 246 and 247 are manually depressed radially inward against the bias of springs 250 to exert a radially inward force on the brush elements through coil springs 252. The brush elements will then project into wiping contact with the conductor sections 170' and 171' which are separated by a non-conductive spacer 254 in which the motor drive shaft is secured to the rotor. Contacts 254 are closed by depressing control plug 247 to effect energization of the blower motor 50' and blower operation. Burner operation on the other hand may be effected by depressing both control plugs 246 and 247.

According to a further embodiment shown in FIG. 14, a lower housing section 14'' encloses drive motor 50' positioned within a recess 260 of an annular body 262 internally fitted into the lower housing section in abutment with the lower end of an upper housing section 16''. The motor shaft projects into a central opening 264 of body 262 and is connected by an axially removable spline member 266 to a depending shaft portion 268 of a rotor 64''. The rotor encloses a cylindrical combustion chamber internally lined by an insulator sleeve 270 backing a heating coil 212. The upper housing section has a top wall 198'' from which a downwardly converging wall formation 108' depends into the combustion chamber to enclose a material storing chamber 22''. Removable cover 20'' is provided for chamber 22''. The lower end portion of formation 108' has radial vanes 272 extending inwardly from its outer wall to a hub 274 that is centered on a bearing pin 276 projecting from an upwardly converging formation 278 on the bottom wall of rotor 64''. Material descending from chamber 22'' is ground between the lower edges of vanes 272 and an externally knurled surface 280 of formation 278 rotating with the rotor. Air passages 282 in the rotor body supply combustion supporting air to the combustion chamber and to enhance migration of ground material toward the burner element. Electrical contact is established with the burner element through brushes 284 spring biased into engagement with split commutator sections 286 held on shaft portion 268 by an insulated compression ring 288.

Having thus described various embodiments of the invention in detail, it will be understood that changes and modifications may suggest themselves to persons skilled in the art, all falling within the scope of the invention as defined by the appended claims.

What is claimed is:

1. In an apparatus for generating and dispensing smoke, having combustion chamber means into which combustible material is fed, and burner means for combustion of the material within said combustion chamber means, the improvement comprising means mounting the burner means in operative relation to the combustion chamber means for transfer of motion therebetween during said combustion of the material, means for rotating the combustion chamber means during operation of the burner means, and blower means mounted in operative relation to the combustion chamber means for inducing outflow of combustion products therefrom.

2. The improvement as defined in claim 1 wherein said combustion chamber means comprises a rotor body having an internal surface enclosing a combustion zone, said means for mounting the burner means including an internal surface of the rotor body within which the burner means is seated for exposure to the material fed to the combustion zone.

3. The improvement as defined in claim 2 wherein said blower means is secured to the rotor body for expelling smoke generated in the combustion zone.

4. The improvement as defined in claim 2 including a hopper within which the material is stored, and means for directing the material from the hopper into the combustion zone.

5. The improvement as defined in claim 4 wherein said material directing means includes a wall formation between the hopper and the combustion zone having a conical portion projecting into the hopper, and a plurality of feed openings formed in the formation wall radially outward of the conical portion.

6. The improvement as defined in claim 4 wherein said material directing means includes a wall formation between the hopper and the combustion zone having a feed opening formed therein and a plurality of feed directing vanes projecting therefrom.

7. The improvement as defined in claim 4 wherein said blower means is secured to the rotor body for expelling the smoke generated in the combustion zone.

8. The improvement as defined in claim 7 including control means having contact sections mounted on the rotor body and electrically connected to the heating element, brush means mounted for displacement into wiping contact with the contact sections and actuating means movably mounted for engagement with the brush means.

9. The improvement as defined in claim 7 including a housing having two relatively movable sections, and control means including switch means responsive to relative displacement of said housing sections for completing an energizing circuit through the heating element.

10. The apparatus as defined in claim 9 wherein said switch means includes contact sections mounted on the rotor body and electrically connected to the heating element, brush means mounted for displacement into wiping contact with the contact sections and actuating means movably mounted in the housing for engagement with the brush means.

11. The apparatus as defined in claim 1 including a housing having two relatively movable section, and control means including switch means responsive to relative displacement of said housing sections for completing an energizing circuit through the heating element 12. The improvement as defined in claim 1 wherein said combustion chamber means comprises a rotor having a generally conical internal surface enclosing a combustion zone and a hub portion projecting into the combustion zone, said burner mounting means including means on the internal surface of the rotor within which the burner means is seated for exposure to the material fed to the combustion zone.

13. The improvement as defined in claim 12 including a screen element secured to the hub portion of the rotor.

14. The improvement as defined in claim 13 including a housing enclosing the rotor, an internal wall formation on the housing enclosing a hopper chamber and grinding means mounted on the wall formation in operative relation to the screen element for comminuting the material fed from the hopper chamber to the combustion zone through the screen element.

15. In an apparatus for generating and dispensing smoke, having a hopper within which combustible material is stored, burner means for combustion of the material and blower means mounted in operative relation to the hopper and the burner means for inducing movement of the material from the hopper to the burner means, the improvement comprising means for rotating the burner means with the blower means relative to the hopper during said movement of the material, and means for directing said movement of the material from the hopper tothe burner means.

16. The improvement as defined in claim 15 wherein said blower means includes a rotor body and blower vanes mounted on the rotor body upstream of the burner means in the direciton of said movement of the material.

17. The improvement as defined in claim 16 wherein said material directing means comprises a conical wall formation projecting axially into the burner means and enclosing the hopper therein.

18. The improvement as defined in claim 17 including a screen element, said conical wall formation having a feed opening upstream of the blower vanes through which the material is fed into the burner means, and grinding edge means mounted on the wall formation at the opening in operative relation to the screen element for comminuting the material entering the burner means.

19. The improvement as defined in claim 18 including spring support means on which the screen element is mounted for biasing the screen element toward the grinding edge means.

20. The improvement as defined in claim 18 including flexible cover means mounted on the wall formation for selectively compacting the material stored in the hopper.

21. The improvement as defined in claim 18 including means for adjustably metering feed of the material from the hopper to the combustion chamber.

22. The improvement as defined in claim 15 including a screen element, said material directing means comprising a conical wall formation converging axially toward the screen element within the burner means in enclosing relation to the hopper.

23. The improvement as defined in claim 22 including yieldable support means on which the screen element is mounted in operative relation to the wall formation.

24. The improvement as defined in claim 22 including flexible cover means mounted on the wall formation for selectively compacting the material stored in the hopper.

25. The improvement as defined in claim 22 including means for adjustably metering feed of the material in the hopper toward the screen element.

* * * * *